US009668573B2

(12) United States Patent
Salani

(10) Patent No.: US 9,668,573 B2
(45) Date of Patent: Jun. 6, 2017

(54) WINE BOTTLE RACK-BUILDING KIT, PACKAGING, AND METHOD

(71) Applicant: Larry A. Salani, Palatine, IL (US)

(72) Inventor: Larry A. Salani, Palatine, IL (US)

( * ) Notice: Subject to any disclaimer, the term of this patent is extended or adjusted under 35 U.S.C. 154(b) by 0 days.

(21) Appl. No.: 14/928,307

(22) Filed: Oct. 30, 2015

(65) Prior Publication Data

US 2016/0120307 A1 May 5, 2016

Related U.S. Application Data

(60) Provisional application No. 62/075,359, filed on Nov. 5, 2014.

(51) Int. Cl.

| | |
|---|---|
| ***A47B 73/00*** | (2006.01) |
| ***A47B 43/00*** | (2006.01) |
| ***A47B 47/00*** | (2006.01) |
| ***A47B 57/00*** | (2006.01) |
| ***B65D 25/10*** | (2006.01) |
| ***B65D 25/54*** | (2006.01) |
| ***B65D 85/00*** | (2006.01) |
| ***A47F 7/28*** | (2006.01) |
| ***A47F 7/00*** | (2006.01) |

(Continued)

(52) U.S. Cl.

CPC ..... *A47B 73/006* (2013.01); *A47B 47/0075* (2013.01); *A47B 47/0091* (2013.01); *A47F 7/0035* (2013.01); *A47F 7/28* (2013.01); *B65D 5/4204* (2013.01); *B65D 5/505* (2013.01); *B65D 25/10* (2013.01); *B65D 25/54* (2013.01); *B65D 85/70* (2013.01)

(58) Field of Classification Search

CPC ..... B65D 5/4204; B65D 5/505; B65D 85/70; B65D 25/10; B65D 25/54; B65D 69/00; B65D 85/20; B65D 75/002; B65D 85/62; A47B 73/006; A47B 47/0075; A47B 47/0091; A47B 73/00; A47B 47/0016; A47B 47/0041; A47B 47/028; A47B 47/06; A47B 47/042; A47B 87/02; A47B 87/0207; A47B 55/06; A47B 2230/0092; A47B 2230/16; A47B 2230/08; A47B 2230/01; A47B 2230/0085; A47B 2220/0083; A47F 7/28; A47F 7/281; A47F 7/283; A47F 7/0007; A47F 7/0021; A47F 7/0028; A47F 7/0035; A47F 5/11; A47F 5/112; A47F 5/116; A47G 23/02; A47G 23/0241

USPC ..... 211/74, 72, 188, 194, 182; 220/4.28, 220/528; 206/443, 446, 577, 497, 499; 446/106–108, 110, 111

See application file for complete search history.

(56) References Cited

U.S. PATENT DOCUMENTS 2,510,591 A * 6/1950 Listman ..... B65D 71/0003 206/199

2,633,662 A 4/1953 Nelson (Continued)

*Primary Examiner* — Jennifer E Novosad

(74) *Attorney, Agent, or Firm* — Charles F. Meroni, Jr.; Meroni +Meroni, P.C.

(57) ABSTRACT

A modular rack for storing wine bottles comprising a plurality of base frames, said base frames being rectangular and provided in a center thereof with a circular hole and in a periphery thereof with a plurality of slots, a plurality of support rods provided in a periphery thereof with a plurality of slots; and said plurality of slots capable of coupling with any other of said plurality of slots when mated perpendicularly thus forming a friction-lock.

12 Claims, 8 Drawing Sheets

(51) Int. Cl.
*B65D 5/42* (2006.01)
*B65D 5/50* (2006.01)

(56) References Cited

U.S. PATENT DOCUMENTS 3,195,507 A * 7/1965 Miller ..... A01K 31/14 119/431
3,379,315 A * 4/1968 Broadwin ..... B01L 3/0217 211/189
3,746,178 A * 7/1973 Wagschal ..... A47B 73/006 211/194
3,854,590 A * 12/1974 Dolby ..... A47G 23/0241 211/74
3,870,155 A * 3/1975 Galloway ..... A47B 73/006 211/188
4,093,076 A * 6/1978 Newton ..... A47B 73/006 211/189
4,270,662 A * 6/1981 Gonzalez ..... A47B 73/006 211/186
4,422,555 A * 12/1983 Jacobs ..... A47B 73/006 211/189
D272,699 S * 2/1984 Godfrey ..... 211/74
4,558,980 A 12/1985 Sturdivan
4,715,503 A 12/1987 Johnson
5,285,907 A * 2/1994 Franchere ..... A47B 87/00 211/194
5,472,098 A * 12/1995 Ho ..... A47B 23/042 211/189
5,947,305 A * 9/1999 Lin ..... A47B 73/006 211/74
5,960,981 A * 10/1999 Dodson ..... B65D 90/52 220/507
5,979,678 A * 11/1999 Kelly ..... A47B 47/0075 211/189
6,615,996 B1 * 9/2003 Ivey ..... A47B 73/006 206/175
6,722,510 B1 * 4/2004 Sen ..... A47B 73/00 211/13.1
7,168,580 B2 1/2007 Larimer et al.
7,662,014 B2 2/2010 Fleishman
8,413,823 B2 4/2013 Hardy
8,458,980 B2 6/2013 Ivanov
8,662,326 B2 * 3/2014 Brick ..... A47B 47/042 211/186
9,039,834 B2 5/2015 Craven et al.
2001/0021618 A1 9/2001 Clever et al.
2001/0037987 A1 * 11/2001 Culp ..... A47B 47/042 211/186
2005/0011843 A1 * 1/2005 Dagan ..... A47F 7/283 211/74
2006/0209815 A1 * 9/2006 Castro-Estevez .. A47B 47/0075 370/379
2007/0017884 A1 * 1/2007 Yang ..... A47B 73/006 211/74
2007/0108144 A1 * 5/2007 Flick ..... C12H 1/22 211/74
2007/0228902 A1 * 10/2007 Frey ..... A47B 43/00 312/257.1
2008/0308508 A1 * 12/2008 Fischer ..... A47B 73/00 211/2
2009/0014346 A1 * 1/2009 Voissem ..... B65D 71/0096 206/416
2009/0289018 A1 * 11/2009 Yang ..... A47B 73/006 211/74
2012/0067771 A1 * 3/2012 Roh ..... A47B 73/00 206/745
2013/0062299 A1 * 3/2013 Beaty ..... A47F 5/116 211/153
2013/0341295 A1 * 12/2013 Dixon ..... A47B 73/00 211/74
2015/0076091 A1 * 3/2015 Lee ..... A47B 73/006 211/85.4
2016/0120307 A1 * 5/2016 Salani ..... A47B 73/006 206/776

* cited by examiner

WINE BOTTLE RACK-BUILDING KIT, PACKAGING, AND METHOD

BACKGROUND OF THE INVENTION

Field of the Invention

The present invention generally relates to a wine rack assembly and building kit and associated methods. More particularly, the present invention relates to a kit formed of interchangeable parts which are capable of locking together to form wine racks and other storage containers enabling a customer to customize their storage space for both efficiency and aesthetics.

Discussion of the Prior Art

U.S. Pat. No. 4,558,980 ('980 Patent), which issued to Sturdican, discloses a Multi-Leaved Tablet and Method of Forming Same. The '980 Patent describes a multi-leaved tablet of this invention consists of leaves with corresponding surface portions adhesively interconnected and with corresponding surface portions free to fold relative to adjacent leaves. The leaves are of predetermined configuration and are die cut from a plurality of panels arranged so that they overlap. An area of adhesive interconnects portions of the surfaces of adjoining panels. This area has a rectilinear peripheral segment, and each die-cut leaf includes at least a portion of the rectilinear peripheral segment of the adhesive area. The rectilinear peripheral segment of the adhesive area is coincident with the folding axes of the leaves.

U.S. Pat. No. 4,715,503 ('503 Patent), which issued to Johnson discloses an Interlocking Joint Wine Rack. The '503 Patent essentially describes a wine rack which has no fasteners or adhesives at the three-dimensional joints, but rather the joints are all formed so that the three intersecting cross pieces interlock in such a way that a tight joint construction occurs strictly by virtue of the way the members are cut in the joint region, and the way in which the members are interlocked. The interlocking and connecting of cubic cells provides a rigid structure capable of accepting loads in any direction and allowing the rack to be mounted in any orientation, with single point wall mounting possible wherein the rack can withstand full loading with no distortion. The modular cell configuration is adapted to the construction of lattice beams and other arrangements besides wine racks.

U.S. Pat. No. 5,947,305 ('305 Patent), which issued to Lin, discloses a Modular Rack for Wine Bottles. The '433 Patent describes a modular rack for holding wine bottles is formed of a plurality of base frames and support rods. The base frames are provided in the center thereof with a bottle-holding space and in the periphery thereof with a plurality of tenons, mortises, and slots. The base frames are arranged together in various ways such that the tenons of one of the base frames are retained in the mortises of another one of the base frames, and that the support rods are engaged with the slots of the base frames.

U.S. Pat. No. 7,168,580 ('580 Patent), which issued to Larimer et al., describes a Rack. The '580 Patent describes a rack which includes a first lower wire bend, a second lower wire bend, a first upper wire bend, and a second upper wire bend. The first section also includes a first pivot coupling into which is received a first end of each of the first and second lower wire bends and into which is received a first end of each of the first and second upper wire bends. The first section also includes a second pivot coupling into which is received a second end of each of the first and second lower wire bends and into which is received a second end of each of the first and second upper wire bends.

U.S. Pat. No. 7,946,544 ('544 Patent), which issued to Benshetrit, describes a Folding Support or Frame Structure. The '544 Patent discloses a structure that has an open and closed configuration. In the open configuration, the structure is free standing and is able to support weight. In the closed configuration, the structure is flat. The structure is formed of two elements that are interlocked at their corners in a manner that allows them to pivot with respect to each other. Chamfered surfaces on the sides of the elements provide stops limiting the motion between the elements. Several structures may be combined to form composite products.

U.S. Pat. No. 9,038,834 ('834 Patent), which issued to Liu, describes a simple shelving structure that can be readily and rapidly installed. The '834 Patent describes a shelving structure which may include a predetermined number of shelf boards, rear plates, connecting members, and frame members. The shelf board is a rectangular board with two expanded side edges. The rear plate is a hexagonal plate with corners modified into arc-shaped inward recesses and with U-shaped slots extending inwards in the middle of the recesses. The U-shaped slot has continuous undulating bounding edges on both of its sides. The connecting member has two clamping planes linked by a base. The frame member has three equally distributed holding slots extending through both ends. Each outer surface between two neighboring holding slots of the connecting member has a recessed strip with regularly spaced extension plates for installing additional components. The shelving structure can be readily installed or uninstalled and can be modified or rearranged according to space restraint or other requirements.

SUMMARY OF THE INVENTION

Storage racks and storage compartments are routinely needed in the house, or in commercial and industrial applications. They provide an area to suspend and/or protect an object for later use and simple access. Not all spaces, however are capable of accommodating a large, prefabricated storage compartment, thus there is a need for a modular rack which is capable of being adapted to fit into limited or unorthodox spaces to maximize the user's storage space, given the limitations of the environment. Specifically, pertaining to wine bottles, storage racks of standardized size and design cannot be arranged or fitted together in a variety of ways in to accommodate the varying numbers of bottles a user would wish to store, nor are they capable of being placed in small or unorthodox spaces while accommodating the desired number of bottles of wine a user may wish to store. Additionally, pre-fabricated storage racks are often expensive and cumbersome limiting much of their utility to a consumer. Therefore the present invention contemplates a modular rack which is intended to hold wine bottles and is composed of units of can be arranged or fitted together in a variety of ways in a do-it-yourself (DIY) manner.

Furthermore, a limitation of a storage rack or storage compartment is that, by design, it creates a space that is unoccupied, i.e. for holding a bottle of wine. However, this is an impediment when storing or shipping the storage rack itself as it occupies a much greater space than is desired. Oftentimes, as a result, storage racks are expensive to ship whether for sale over the internet, or during a household move. Thus, it is desirable for a storage rack to be capable of being broken down in a way to minimize the amount of so-called "dead space" between the components and reassembled by hand at a subsequent location. Therefore the present invention further contemplates a storage rack which is composed of interchangeable units that can disassembled and stored in a way that minimizes the dead space between the parts, thus facilitating simple storage and shipping of the storage rack and its components.

In one embodiment the invention considers a modular storage rack having at least two interconnecting pieces wherein a first interconnecting piece comprises a linear interconnecting piece comprising at least one matable connection slit, wherein a second interconnecting piece comprises a rectangular interconnecting piece with a circular interior, the exterior comprising at least one matable connection slit, and wherein the first and second interconnecting pieces are joined at the matable connection slits to form the modular storage rack.

In another embodiment the invention considers a modular rack, said modular rack having a plurality of base frames, said base frames being rectangular and provided in a center thereof with a circular hole and in a periphery thereof with a plurality of slots, a plurality of support rods provided in a periphery thereof with a plurality of slots, and said plurality of slots capable of coupling with any other of said plurality of slots when mated perpendicularly thus forming a friction-lock.

In another embodiment the invention considers a method of assembling a modular storage rack, the method having at least the steps of providing a plurality of base frames and a plurality of support rods, said base frames being rectangular and provided in a center thereof with a circular hole and in a periphery thereof with a plurality of slots, said support rods provided in a periphery thereof with a plurality of slots, orienting said plurality of base frames and plurality of support rods to a desired configuration, mating said plurality of base frames and plurality of support rods at said plurality of slots, and thereby assembling said modular storage rack into said desired configuration.

In another embodiment the invention considers a method of assembling a modular storage rack having at least the steps of providing a packaging wherein all components of a modular rack are stored in parallel, said components comprising a plurality of base frames and a plurality of support rods, said base frames being rectangular and provided in a center thereof with a circular hole and in a periphery thereof with a plurality of slots, said support rods provided in a periphery thereof with a plurality of slots, shipping said packaging to a desired location, removing said components from said packaging, orienting said plurality of base frames and plurality of support rods to a desired configuration, mating said plurality of base frames and plurality of support rods at said plurality of slots, and thereby assembling said modular storage rack into said desired configuration.

Such embodiments do not represent the full scope of the invention. Reference is made therefore to the claims herein for interpreting the full scope of the invention. Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief descriptions of drawings.

DETAILED DESCRIPTION OF THE PREFERRED EMBODIMENT

Figure 1:
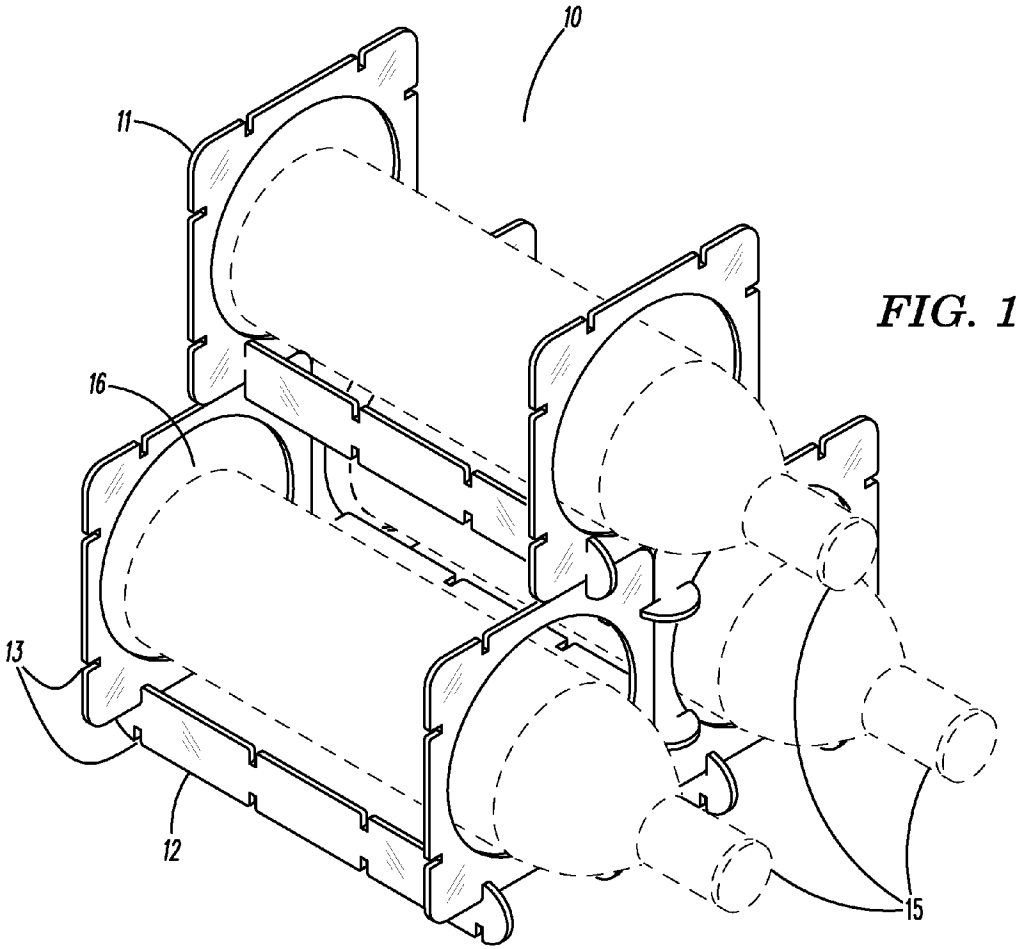
FIG. 1 is a perspective view of a preferred storage rack assembly occupied by wine bottles.

Referring now the drawings with more specificity, the present invention essentially provides a storage rack or wine rack assembly as at 10 in the form of a modular storage rack assembly that can be easily constructed and deconstructed by hand or other similar means. The storage rack 10 according to the present invention preferably comprises a three-dimensional construction comprised of two or more differing types of interlocking pieces the first 11 having a space for holding an item such as a bottle of wine 15; and a second being a supporting and connecting structure 12; each type of interlocking piece having at least one matable connection slit 13.

The storage rack assembly 10 is preferably constructed from any number of moldable polymeric or plastic materials. Preferably the material may be polycarbonate plastic to enhance the rack's strength while maintaining its light-weight and economical features. Such moldable materials may be provided with select coloration such as transparent, clear, white, black, red, green, and other colorings are contemplated in various embodiments. Alternatively, it is further contemplated that the translucent form may be outfitted (i.e. colored materials or media may be added to surfacing of the form 11) with select coloration to effect the desired coloration. Alternatively, it is contemplated that the rack may be constructed from aluminum, nickel, brushed nickel, or other metals or alloys to suit the user's aesthetic and/or durability needs.

The storage rack assembly 10 preferably comprises a three-dimensional construction comprised of two or more differing types of interlocking pieces; the first 11 preferably having a space for holding an item; and a second preferably being a supporting and connecting structure 12; each type of interlocking piece having at least one matable connection slit 13. A storage space 16, occupied in FIG. 1 by wine bottle 15 is preferably defined by two or more base frames 11 connected by two or more support rods 12 thereby defining a space where an item can be stored. Looking now, to FIGS. 2 and 3 connection slits on adjacent parts of the storage rack assembly can be mated by positioning one slit perpendicular to the slit on an adjacent part and applying pressure creating a friction lock 14 between the adjacent pieces of the rack assembly.

Figure 2:
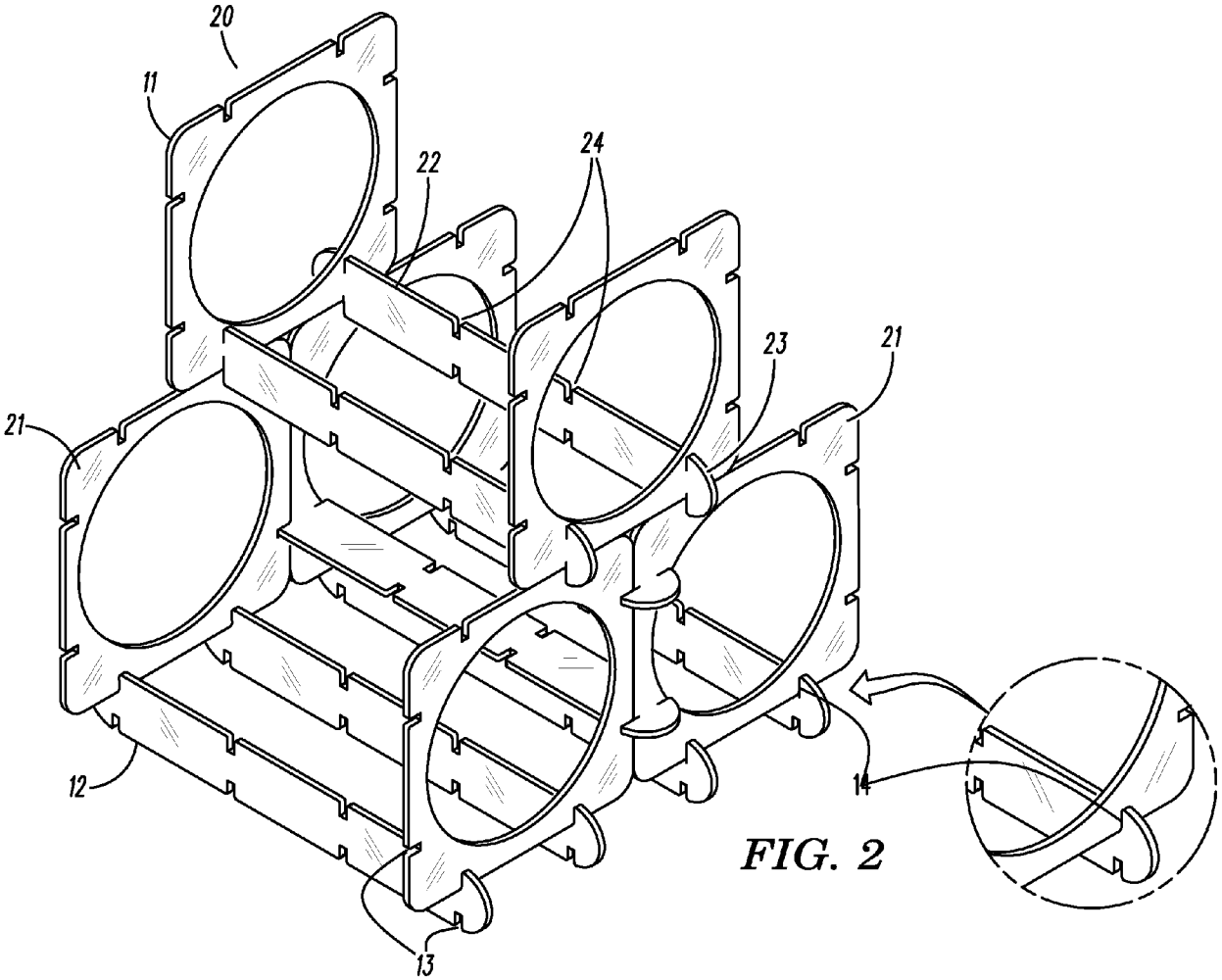
FIG. 2 is a perspective view of the preferred storage rack assembly of FIG. 1 without accompanying wine bottles and with close up view of the mating mechanism of the interconnecting components.
Figure 3:
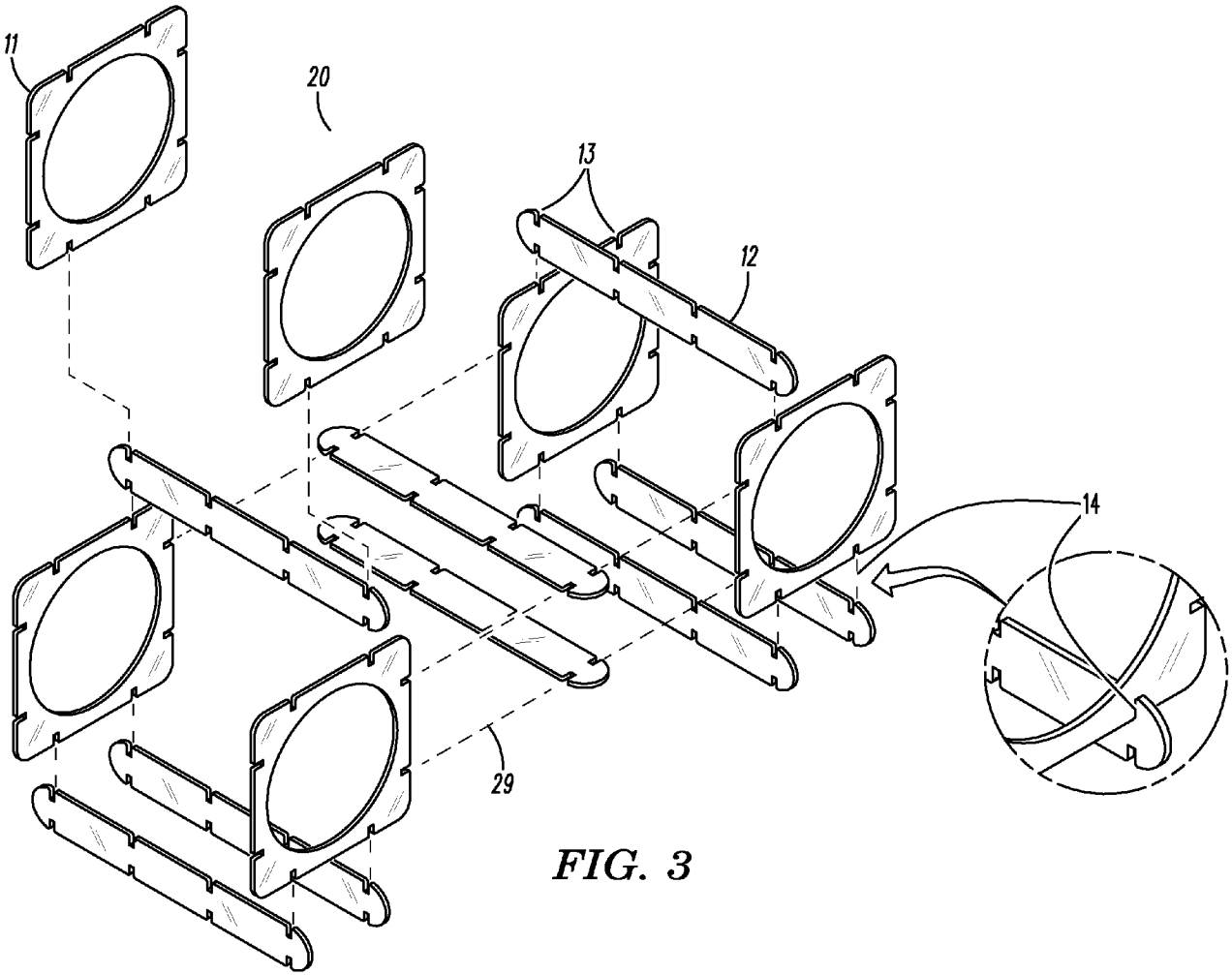
FIG. 3 is an exploded view of the preferred storage rack assembly of FIGS. 1 and 2.
Figure 5:
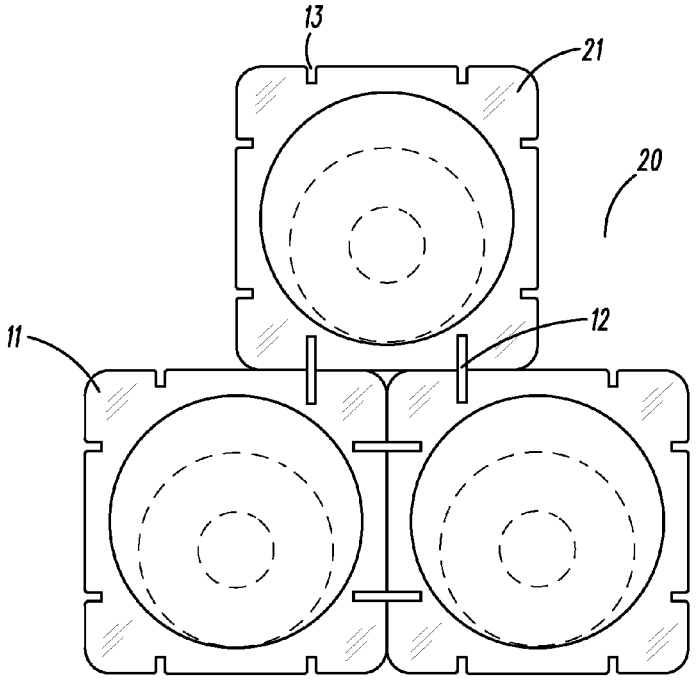
FIG. 5 is a side a side elevation view of the preferred configuration of FIGS. 1, 2, and 3.

FIGS. 2, 3, and 5 illustrate a preferred step pyramid type embodiment 20 of the invention. Preferably the step pyramid is composed of at least six of base frames 11 and at least ten support rods 12. In such an embodiment, a side elevation view demonstrates that the front and back faces 21 are formed by three base frames arranged in a triangular or step pyramid configuration. In such a configuration two base modules 11 form a base and are straddled by a third base module 11. The front and back faces 21 are connected by linking support rods 12. The links 29 between pieces in this particular embodiment are further illustrated by way of example in FIG. 3.

While the figures relating to this embodiment show the faces of the pyramid 21 oriented at the outermost mating slit 13 on the support rods 22, 23, it is contemplated (for this and other embodiments) that one or more base modules 11 may be moved to an inner mating slit 24, 25 to narrow the space between the base modules to accommodate smaller bottles or other articles to be stored on the rack.

Figure 4:
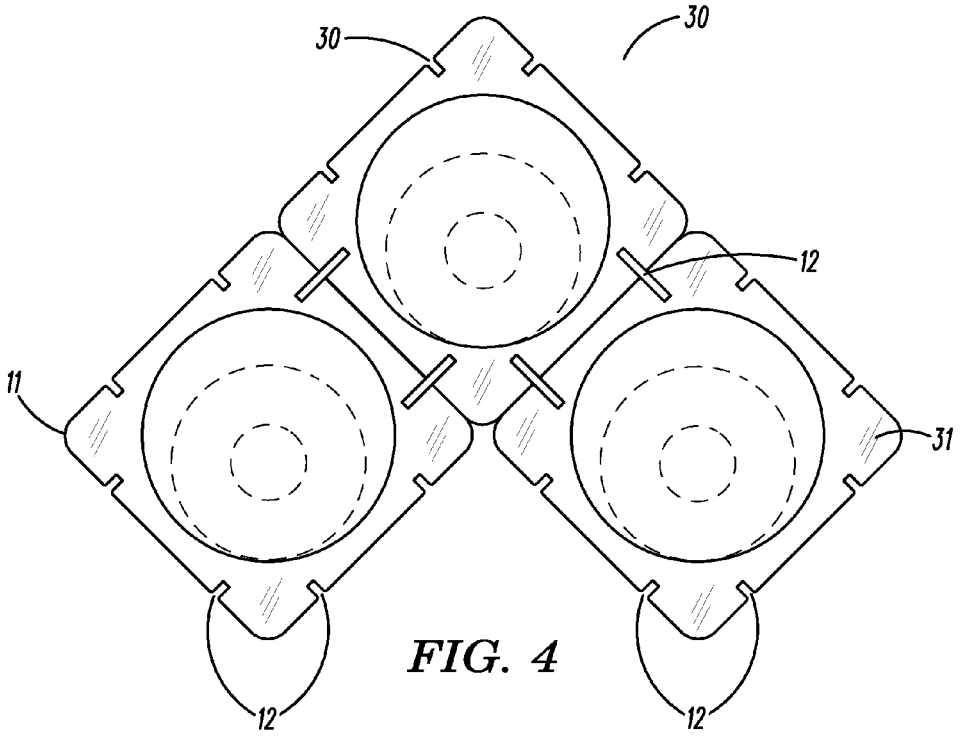
FIG. 4 is a side elevation view of a preferred configuration of a storage rack assembly.

FIG. 4 illustrates a preferred L-shaped or bent embodiment 30 of the invention. Preferably the L-shape embodiment is composed of at least six of base frames 11 and at least four support rods 12. In such an embodiment, a side elevation view demonstrates that the front and back faces 31 are formed by three base frames arranged in a L-shape as seen in FIG. 4. In such a configuration two base modules 11 form a line and are connected to a third base module 11 perpendicular or at a 90 degree angle from the direction of such a line. The front and back faces 31 are connected by linking support rods 12. In addition to the support rods 12 show, it may be desirable to place additional support rods 12 at the matable slits 32 at the bottom of the construction to increase the stability in this embodiment.

Figure 6:
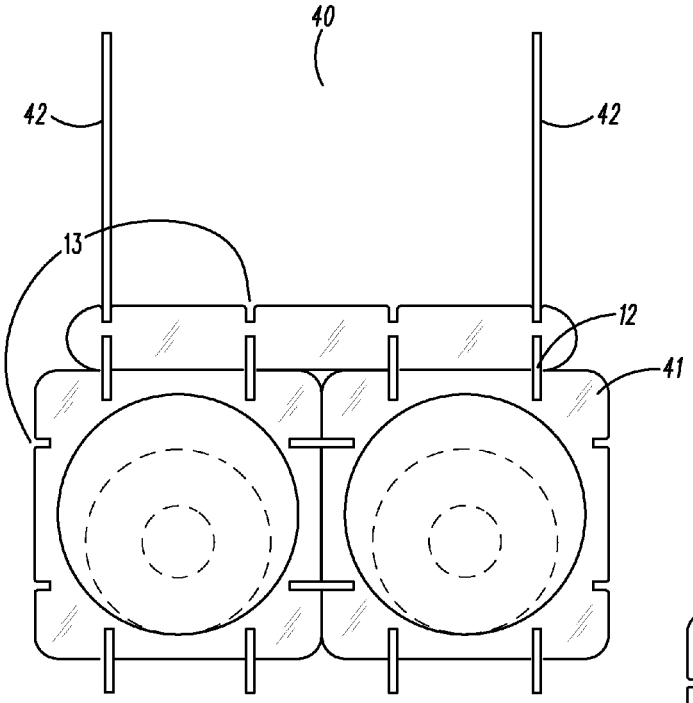
FIG. 6 is a side elevation view of a preferred configuration of a storage rack assembly having one face rotated perpendicular to the side on view.

FIG. 6 illustrates a preferred offset pyramid type embodiment 40 of the invention. Preferably the offset step pyramid is composed of at least six of base frames 11 and at least ten support rods 12. In such an embodiment, a side elevation view demonstrates that the front and back faces 41 are formed by two base frames 11 arranged in a linear configuration and two additional base frames 11 rotated perpendicular to the faces 41 forming a second set of faces 42. The front and back faces 41 are connected by linking support rods 12. The second set of faces 42 straddle connecting support rods 12 that connect the top portions of the first set of faces 41. Noticeably, in such an embodiment, the rotated base frames are elevated comparatively to the face 41 compared to in previous embodiments where all the base frames form a unified face.

Figure 7:
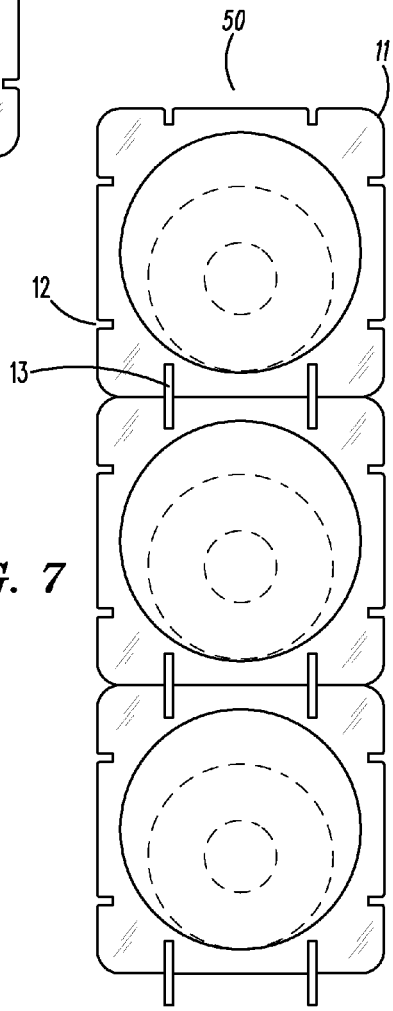
FIG. 7 is a side elevation view of a preferred linear configuration of a storage rack assembly.

FIG. 7 illustrates a preferred linear embodiment 50 of the invention. Preferably the linear embodiment is composed of at least six of base frames 11 and at least six support rods 12. In such an embodiment, a side elevation view demonstrates that the front and back faces 51 are formed by three base frames arranged in a linear or I-shape as seen in FIG. 7. In such a configuration three base modules 11 form a line. The front and back faces 51 are connected by linking support rods 12. In addition to the support rods 12 show, it may be desirable to place additional support rods 12 at any of the matable slits 13 at the periphery of the construction to increase the stability in this embodiment, or to connect to another construction.

FIGS. 8-15 illustrate preferred embodiments of various constituent, interchangeable parts that may preferably be used to form a modular storage rack or wine rack 10.

Figure 8:
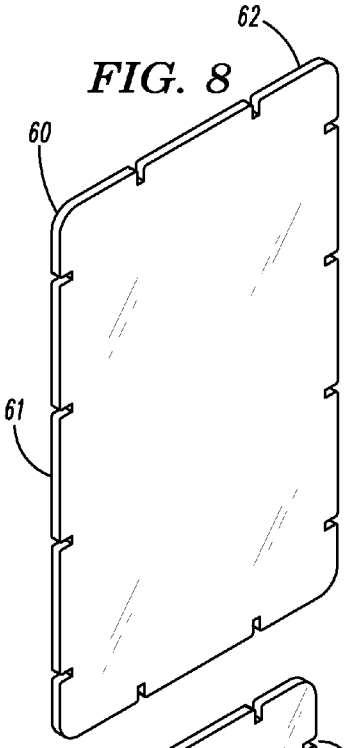
FIG. 8 is a perspective view of a component piece to certain preferred embodiments of a storage rack assembly.

Referring specifically now to FIG. 8, FIG. 8 illustrates a rectangular backing piece 60 for use in wine rack constructions. In a preferred embodiment, backing piece 60 utilizes twelves matable slits 13 around the periphery. Preferably, two longer sides 61 contain four matable slits 13 and the two shorter sides 62 contain two matable slits 13. Referring with specificity, backing piece 60 preferably has a thickness of ⅛ inches (⅛"). Matable slits 13 are preferably ⅛" wide and ¼" deep, preferably matable slits 13 are preferably spaced, with 2⅛" spacing between edges of each slit.

Figure 9:
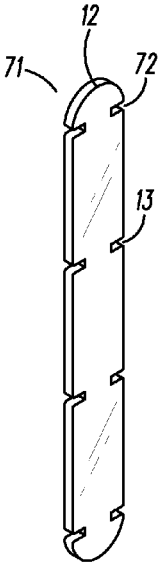
FIG. 9 is a perspective view of a component piece to certain preferred embodiments of a storage rack assembly.

FIG. 9 illustrates a perspective view of support rod 12. In a preferred embodiment support rod 12 has eight matable slits 13 on its periphery with four on each of its longer sides. Support rod 13 also has rounded edges 71. Referring with specificity, support rod 12 preferably has a length of 7.85", a width of 1", and a thickness of ⅛". Matable slits 13 are preferably ⅛" wide and ¼" deep, matable slits 13 are preferably spaced, with 2⅛" spacing between edges of each slit. The distance from the edge of the outermost matable slit 72 to the top of the rounded edge 71 preferably is 31/64", and the radius of rounded edge 71 is 5/16".

Figure 10:
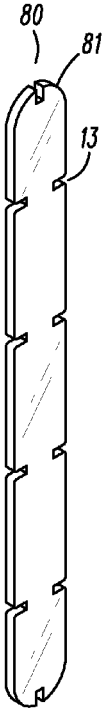
FIG. 10 is a perspective view of a component piece to certain preferred embodiments of a storage rack assembly.

FIG. 10 illustrates a perspective view of elongated support rod 80. In a preferred embodiment support rod 80 has ten matable slits 13 on its periphery with four on each of its longer sides and one occupying the center of each rounded edge 81. Referring with specificity, support rod 80 preferably has a width of 1" and a thickness of ⅛". Matable slits 13 are preferably ⅛" wide and ¼" deep, matable slits 13 are preferably spaced, with 2⅛" spacing between edges of each slit.

Figure 11:
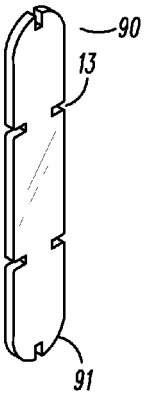
FIG. 11 is a perspective view of a component piece to certain preferred embodiments of a storage rack assembly.

FIG. 11 illustrates a perspective view of shortened support rod 90. In a preferred embodiment support rod 90 has eight matable slits 13 on its periphery with three on each of its longer sides and one occupying the center of each rounded edge 91. Referring with specificity, support rod 90 preferably has a width of 1" and a thickness of ⅛". Matable slits 13 are preferably ⅛" wide and ¼" deep, matable slits 13 are preferably spaced, with 2⅛" spacing between edges of each slit.

Figure 12:
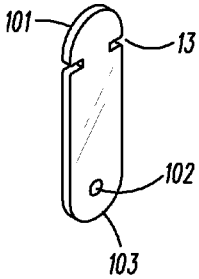
FIG. 12 is a perspective view of a component piece to certain preferred embodiments of a storage rack assembly.

FIG. 12 illustrates a perspective view of pivoting support rod 100. In a preferred embodiment pivoting support rod 100 has two matable slits 13 on its periphery with one on each of its longer sides near rounded edge 101. A hole 102 is located at the radial center of opposing curved edge 103 where a user may connect a pin, nail, or other circular connecting device to allow parts of the construction to be attached to other constructions such as a wall, desktop, bookcase, etc. Such a connection may be fixed or pivotable depending on the user's choice of connecting means. Referring with specificity, pivoting support rod 100 preferably has a width of 1" and a thickness of ⅛". Matable slits 13 are preferably ⅛" wide and ¼" deep.

Figure 13:
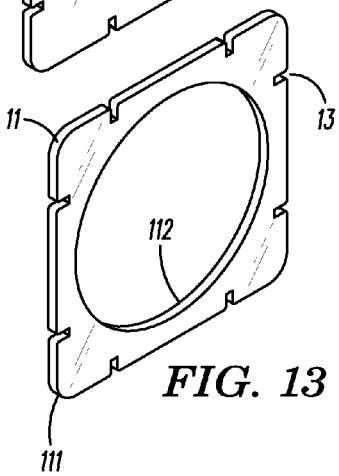
FIG. 13 is a perspective view of a component piece to certain preferred embodiments of a storage rack assembly.

FIG. 13 illustrates a perspective view of base frame 11 In a preferred embodiment base frame 11 has eight matable slits 13 on its periphery with two on each of its sides. Base frame 11 also has rounded edges 111, and an inner circular cutout 112. Referring with specificity, base frame 11 preferably has a length of 4½", a width of 4½", and a thickness of ⅛". Matable slits 13 are preferably ⅛" wide and ¼" deep, matable slits 13 are preferably spaced, with 2⅛" spacing between edges of each slit. The distance from the edge of a matable slit 12 to the top of the rounded edge 111 preferably is 1 1/16", and the radius of rounded edges 111 is 5/16". Inner circle 112 preferably has a diameter of 3 12/16".

Figure 14:
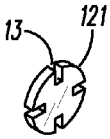
FIG. 14 is a perspective view of a component piece to certain preferred embodiments of a storage rack assembly.

FIG. 14 illustrates a perspective view of connecting piece 121. In a preferred embodiment connecting piece 121 has four matable slits 13 on its periphery spaced 90 degrees from each other around the edge of the circular piece. Referring with specificity, connecting piece 121 preferably has a thickness of ⅛". Matable slits 13 are preferably ⅛" wide and ¼" deep.

Figure 15:
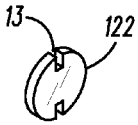
FIG. 15 is a perspective view of a component piece to certain preferred embodiments of a storage rack assembly.

FIG. 15 illustrates a perspective view of connecting piece 122. In a preferred embodiment connecting piece 122 has two matable slits 13 on its periphery spaced 180 degrees from each other around the edge of the circular piece. Referring with specificity, connecting piece 121 preferably has a thickness of ⅛". Matable slits 13 are preferably ⅛" wide and ¼" deep.

FIGS. 16-19 illustrate preferred embodiments of various packaging styles, materials, and means that may preferably be used to transport or display modular storage rack or wine rack 10.

Figure 16:
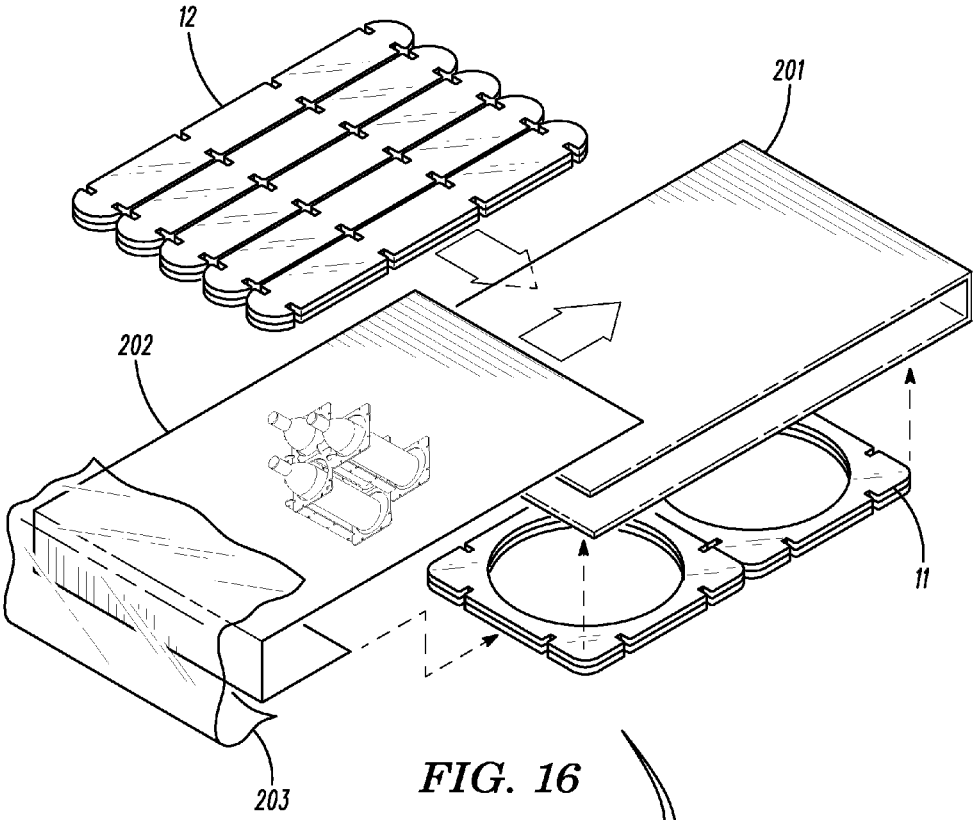
FIG. 16 is an exploded view of a preferred embodiment of the storage rack assembly for shipping and accompanying packing materials.
Figure 17:
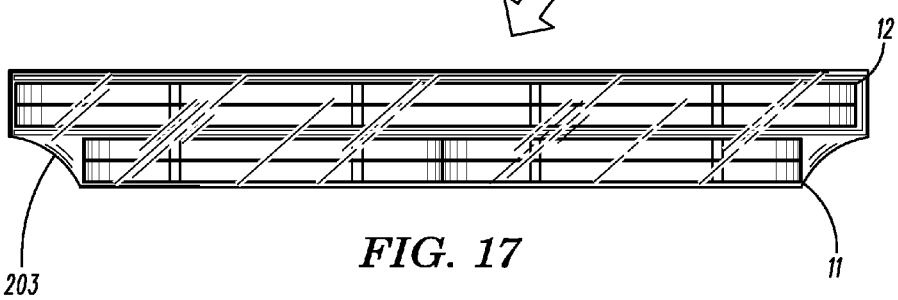
FIG. 17 is a side elevation view of the embodiment of FIG. 16 displayed fully packed.

FIGS. 16 and 17 specifically illustrate a preferred, compact, shipping embodiment of the storage and wine rack 10. This embodiment can transport at least six base modules 11 and at least ten connecting rods 12. Base modules 11 are preferably stacked into two columns and connecting rods 12 are preferably stacked into five columns. After the base modules 11 and connecting rods 12 are stacked together they are placed into containment means 201, which is preferably stock or cardboard. This is covered by decorative covering 202 which is preferably composed of some paper or stock. The shipping apparatus is wrapped in plastic wrapping 203 to form a final product for shipping.

Figures 18, 19:
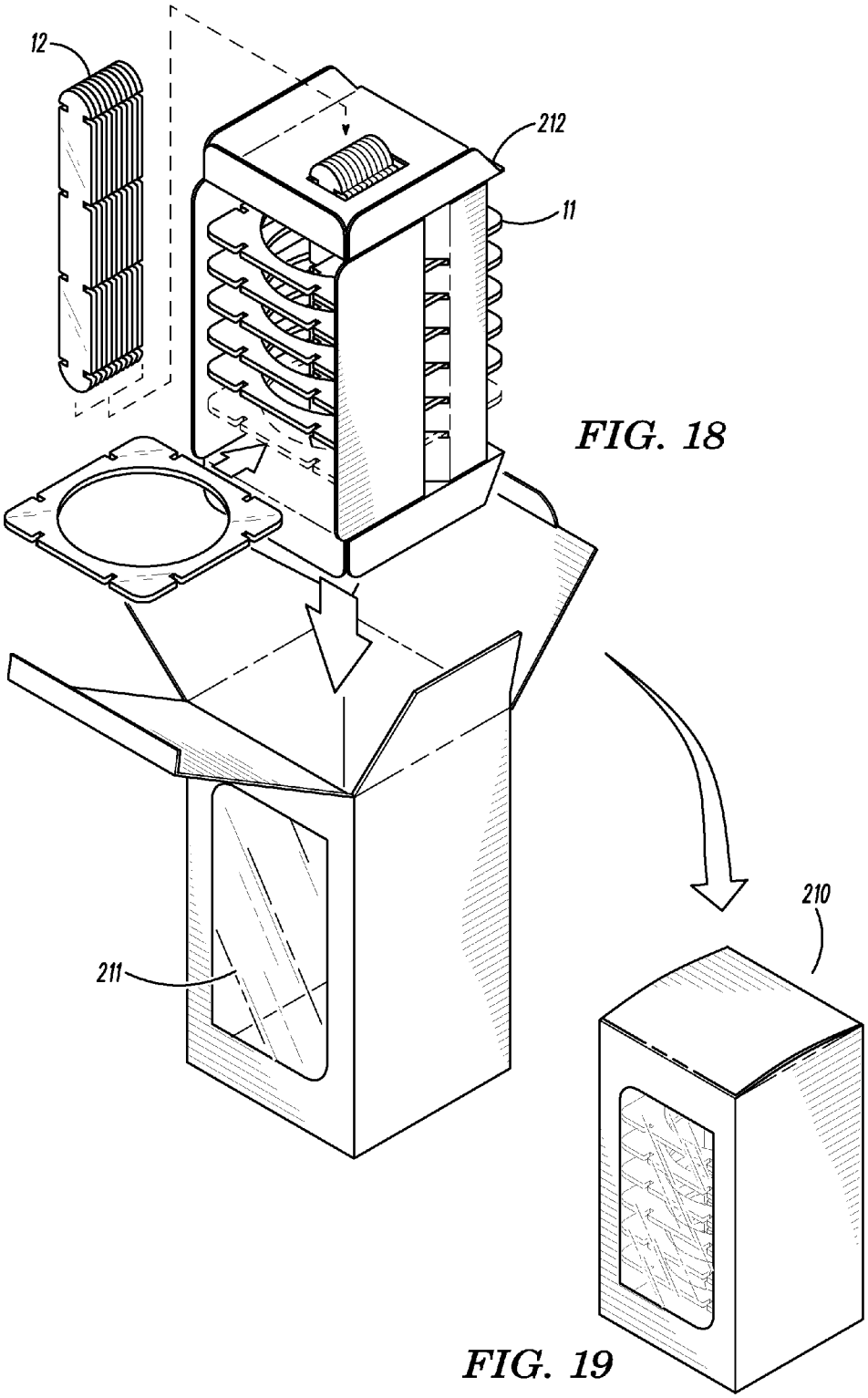
FIG. 18 is an exploded view of a preferred embodiment of the storage rack assembly for display and retail, and accompanying packing materials.
FIG. 19 is a perspective view of the embodiment of FIG. 18 with all materials within the display box.

FIGS. 18 and 19 specifically illustrate a preferred decorative packaging box 210 for display, shipping, and sale of the product. The packaging box preferably has a transparent display 211 for viewing the contents of the box during display in a retail environment. This embodiment can transport at least six base modules 11 and at least ten connecting rods 12. Packaging material 212 holds base modules 11 and connecting rods 12 in a visually pleasing spine-and-ribs alignment for viewing through transparent display 211. The spine-and-ribs alignment essentially secures the connecting rods 12 grouped in the center of the box visible through the transparent display and secures the base modules 11 perpendicular to the first interconnecting pieces such that connecting rods 12 pass through the center hole of the second interconnecting pieces and the base modules 11 are spaced vertically from each other within the box such that they are individually recognizable to the eye.

Referring now to FIG. 3 an exemplary method of assembling a modular storage rack 10 is illustrated. Demonstrated herein, a user provides a plurality of base frames 11 and a plurality of support rods 12. Those frames and rods can be oriented in approximately the way pictured in FIG. 3 to achieve a final configuration 20 (shown assembled in FIG. 2). After arranging the frames and rods as seen in FIG. 3 the use can mate the frames rods at matable slits 13 to form friction locks 14 thereby assembling the storage rack into a final configuration 20. Additional, analogous, methods are contemplated for assembling the preferred embodiments pictured in FIGS. 4-7 as well as various other embodiments not shown.

Accordingly, although the invention has been described by reference to certain preferred and alternative embodiments, it is not intended that the novel arrangements be limited thereby, but that modifications thereof are intended to be included as falling within the broad scope and spirit of the foregoing disclosures and the appended drawings.

I claim:

1. A modular rack, said modular rack comprising:

a plurality of base frames, said base frames being rectangular and provided in a center thereof with a circular hole and in a periphery thereof with a plurality of matable connection slits;

said base frames comprising at least two of said plurality of matable connection slits on each of a first, second, third, and fourth edges of said base frames, said at least two matable connection slits oriented such that the base frames have 90 degree rotational symmetry;

a plurality of support rods provided in a periphery thereof with a plurality of matable connection slits;

said support rods comprising at least three of said plurality of matable connection slits located on a first edge of the support rods and at least three of said plurality of matable connection slits symmetrically located on a second edge of the support rods; and said matable connection slits capable of mating with any other of said matable connection slits when oriented and mated perpendicularly thus forming a friction-lock;

said base frames being arranged such that at least two base frames form a storage compartment;

said storage compartment being formed when said at least two base frames are parallel such that a projection of light through the circular hole of the base frames would form a cylinder;

said at least two base frames connected by at least two support rods;

said at least two base frames connected to the at least two support rods at the at least three of said plurality of matable connection slits, thus forming at least four friction locks.

2. A modular storage rack comprising:

at least two interconnecting pieces;

wherein a first type of said at least two interconnecting pieces comprises a linear interconnecting piece comprising at least one matable connection slit;

wherein a second type of said at least two interconnecting pieces comprises a rectangular interconnecting piece with a circular interior, the exterior comprising at least one matable connection slit;

wherein the at least two interconnecting pieces are joined at the matable connection slits to form the modular storage rack;

wherein the first type of interconnecting piece comprises at least three matable connection slits located on a first edge of the interconnecting piece and at least three matable connection slits symmetrically located on a second edge of the interconnecting piece; and wherein the second type of interconnecting piece comprises at least two matable connection slits on each of a first, second, third, and fourth edges of said second interconnecting piece, said at least two matable connection slits oriented such that the second interconnecting piece has 90 degree rotational symmetry.

3. The modular storage rack of claim 2 wherein:

the at least two interconnecting pieces are formed of transparent polycarbonate plastic.

4. The modular storage rack of claim 2 wherein:

the first type of interconnecting piece comprises at least four matable connection slits located on said first edge of the interconnecting piece and at least four matable connection slits symmetrically located on said second edge of the interconnecting piece.

5. The modular storage rack of claim 4 further comprising:

at least one additional first type of interconnecting piece and at least one additional second type of interconnecting piece; and wherein two of the second type of interconnecting piece are connected by at least two of the first type of interconnecting piece such that the two second type of interconnecting pieces are mounted on the outermost matable slits of the two first type of interconnecting pieces;

thus forming a module capable of storing a bottle.

6. The modular storage rack of claim 5 further comprising:

a second module connected to the first module such that the matable slits of the two first type of interconnecting pieces are joined to matable slits located opposite the two first type of interconnecting pieces of the first module; and a third module connected to the second module such that the matable slits of the two first type of interconnecting pieces are joined to matable slits located opposite the two first type of interconnecting pieces of the second module.

7. The modular storage rack of claim 5 further comprising:

a second module adjacent to the first module;

the second module connected to the first module using two additional first type of interconnecting pieces wherein the two interconnecting pieces are mated to matable slits on a right side of the first module and mated oppositely to matable slits on a left side of the second module; and a third module connected to the first and second modules such that the matable slits of the two first type of interconnecting pieces of the third module are joined to matable slits located opposite the first type of interconnecting pieces of the first and second modules thus spanning the first and second modules and forming a step-pyramid shape.

8. The modular storage rack of claim 5 further comprising:

a second module;

two additional second type of interconnecting pieces; and the two additional second type of interconnecting pieces connected to both the first module and the second module at the outermost, opposite, mating slits of the first type of interconnecting pieces of the first and second module, the first and second module being oriented at a 90 degree angle thus forming an L-shape.

9. The modular storage rack of claim 5 further comprising:

a second module adjacent to the first module;

the second module connected to the first module using two additional first type of interconnecting pieces wherein the two interconnecting pieces are mated to matable slits on the right side of the first module and mated oppositely to matable slits on the left side of the second module; and a third module module connected to the first and second modules such that the face, or open circle of the first type of interconnecting pieces are perpendicular with respect to the faces of the first and second modules.

10. The modular storage rack of claim 4 wherein:

the storage rack comprises at least eight of the first type of interconnecting piece; and at least six of the second type of interconnecting piece.

11. The modular storage rack of claim 10 further comprising:

a packaging means;

said packaging means capable of holding the first type of interconnecting pieces flat in columns two pieces thick and adjacent the second type of interconnecting pieces placed two pieces thick such that the volume is minimized for optimal shipping and minimizing storage space.

12. The modular storage rack of claim 10 further comprising:

a box having a transparent display;

said packaging means securing the first type of interconnecting pieces grouped in the center of the box visible through the transparent display;

said packaging means securing the type of second interconnecting pieces perpendicular to the first type of interconnecting pieces such that the first type of interconnecting pieces pass through the center hole of the second type of interconnecting pieces; and the second type of interconnecting pieces spaced vertically from each other within the box such that they are oriented to form a rib-and-spine display with the first type of interconnecting pieces.

* * * * *